264824 0529 --00 05-15-90 45368 04-10-90 161808 78147.0 04925037 1683

United States Patent [19]

Holley, Jr.

[11] Patent Number: 4,925,037

[45] Date of Patent: May 15, 1990

[54] STORAGE RACK FOR CANNED GOODS ACCOMMODATING VARYING DIAMETERS AND AXIAL LENGTHS

[76] Inventor: Nelson E. Holley, Jr., 838 Whittier Dr., Allentown, Pa. 18103

[21] Appl. No.: 303,269

[22] Filed: Jan. 26, 1989

[51] Int. Cl.[5] ..... A47F 7/00

[52] U.S. Cl. ..... 211/59.2; 211/184

[58] Field of Search ..... 211/59.2, 184, 71, 43, 211/11; 108/60, 61; 221/241, 242

[56] References Cited

U.S. PATENT DOCUMENTS

| | | | |
|---|---|---|---|
| 2,112,498 | 3/1938 | Lax | 211/184 X |
| 2,124,500 | 7/1938 | Taylor | 211/184 X |
| 2,346,430 | 4/1944 | Hauser | 211/184 X |
| 2,855,258 | 10/1958 | Moncier | 211/184 X |
| 3,744,866 | 7/1973 | Cook | 211/59.2 X |
| 3,858,757 | 1/1975 | Langdon, Jr. | 211/59.2 X |
| 3,957,174 | 5/1976 | Palamara | 211/59.2 X |
| 4,595,105 | 6/1986 | Gold | 211/43 |

*Primary Examiner*—Reinaldo P. Machado
*Assistant Examiner*—Sarah A. Lechok
*Attorney, Agent, or Firm*—Steele, Gould & Fried

[57] ABSTRACT

A storage rank for articles has a frame having sidewalls disposed perpendicular to a back plane and an open front, at least one partition perpendicular to the back plane mountable at least at two alternate spacings from the frame sidewalls and from others of the partitions, the partitions being disposed substantially vertically and the alternate spacings corresponding to one of the axial heights and radial widths of the articles, thereby confining the articles when stored between the partitions, and at least one barrier panel mountable on each partition adjacent an edge opposite the back plane, a bottom edge of the barrier panel being spaced from a bottom of the frame by substantially a dimension of the articles such that the articles are movably captive in at least one stack and are confined respectively between the partition and the sidewalls on the one hand, and between the barrier member and the back plane on the other hand.

15 Claims, 2 Drawing Sheets